United States Patent [19]

Hoke

[11] 4,052,578

[45] Oct. 4, 1977

[54] MULTIPLE CAM, MULTIPLE POSITION SWITCH CONTROL MECHANISM WITH JOY-STICK TYPE OPERATOR OPERABLE IN X-Y PLANES

[76] Inventor: William A. Hoke, 517 Overdale Road, Baltimore, Md. 21229

[21] Appl. No.: 649,685

[22] Filed: Jan. 6, 1976

[51] Int. Cl.[2] ..... H01H 3/32; H01H 25/04; G05G 9/00

[52] U.S. Cl. ..... 200/153 L; 200/6 A; 200/18; 74/471 XY

[58] Field of Search ..... 74/471 XY; 200/1 A, 200/5 R, 6 R, 6 A, 6 B, 17 R, 18, 153 L, 153 LB, 153 T

[56] References Cited

U.S. PATENT DOCUMENTS

| | | | |
|---|---|---|---|
| 1,794,193 | 2/1931 | McKerlie | 200/1 A |
| 2,747,035 | 5/1956 | Hansen et al. | 200/6 A X |
| 3,293,381 | 12/1966 | Eitel | 200/6 A |
| 3,360,620 | 12/1967 | Ward | 200/6 A X |
| 3,550,466 | 12/1970 | Ham | 200/6 A X |
| 3,657,493 | 4/1972 | Horsley | 200/153 T X |

*Primary Examiner*—James R. Scott
*Attorney, Agent, or Firm*—Walter G. Finch

[57] ABSTRACT

The invention is a control mechanism for selectively operating one or more motive devices, such as multiple-speed electric motors, either separately or simultaneously in any combination of the speed capabilities thereof. In particular, the present control mechanism provides a plurality of cam elements fixed on two shafts arranged in a cruci-form conformation, the shafts being rotatable either singly or in tandem by a single control handle to engage one or more of the cam elements with contact switch elements which act to complete circuits or otherwise activate associated apparatus.

3 Claims, 6 Drawing Figures

MULTIPLE CAM, MULTIPLE POSITION SWITCH CONTROL MECHANISM WITH JOY-STICK TYPE OPERATOR OPERABLE IN X-Y PLANES

BACKGROUND AND SUMMARY OF THE INVENTION

The invention relates to control apparatus wherein cam elements are selectively movable on rotational displacement of a shaft to contact fixed actuation elements, contact between the cam elements and the actuation elements causing specific work functions to occur. In particular, a single control handle is arranged to control the rotational displacement of at least two shaft elements arranged in a mutually perpendicular relationship, each of the cam elements being fixed to one of the shaft elements and thereby being displaced on rotation of said shaft elements. Selective displacement of the cam elements causes said elements to contact fixed actuation structures, such as well-known roller switches, to activate said structures. The actuation structures interface with devices such as motors, etc. to operate said devices. A common useage of the present invention is as a control mechanism for operating tow multiple-speed electric motors either separately or simultaneously in any combination of speeds through the use of a single control handle. The control handle is capable of alternately displacing each of the shaft elements to position the cam elements carried on said shaft elements in a predetermined fashion, movement of the cam elements to these predetermined positions acting to bias switch elements or the like into active positions. Switch elements of a well-known type having friction rollers which activate electrical circuits on rotational displacement of the rollers can be conveniently employed in the practice of the invention.

The present control mechanism exhibits a variety of functional capabilities, one of the more useful of which is the ability to operate two motive devices, such as multiple-speed motors, with one hand from one control station. The present invention provides this capability due to the structural provision whereby at least two shaft elements can be rotationally displaced by one control handle. Thus, an operator of the invention need use only one hand to control at least two motors either separately or simultaneously throughout the full range of speeds of each of the motors. The cam elements carried on the aforementioned shaft elements can be configurated in a variety of ways depending on operational requirements. For example, previously activated actuation or switch elements can be maintained in an active position when a successive actuation element is activated or, alternatively, as succeeding actuation elements are activated, previously activated actuation elements can be inactivated. As can clearly be seen, any desired combination of the foregoing capabilities can be accomplished through simple modification of the camming surfaces of the cam elements. It is also believed to be apparent from the teachings of the invention that any desired number of cam elements can be carried on the shaft elements to correspond to and control the multiple operations of which the motive devices being controlled are capable.

It is therefore an object of the invention to provide a control mechanism capable of operating at least two multiple-operation motive devices, such as multiple-speed motors, either separately or simultaneously in any combination of operation thereof.

It is another object of the invention to provide a control mechanism operable by means of a single control handle, such as of the "joy stick" type, whereby at least two multiple-operation motive devices can be either separately or simultaneously controlled throughout the full range of operational combination of which said motive devices are capable.

Further objects and advantages of the invention can be understood and appreciated in light of the following detailed description of the preferred embodiment of the invention.

BREIF DESCRIPTION OF THE DRAWINGS

DESCRIPTION OF THE PREFERRED EMBODIMENTS

Figure 2:
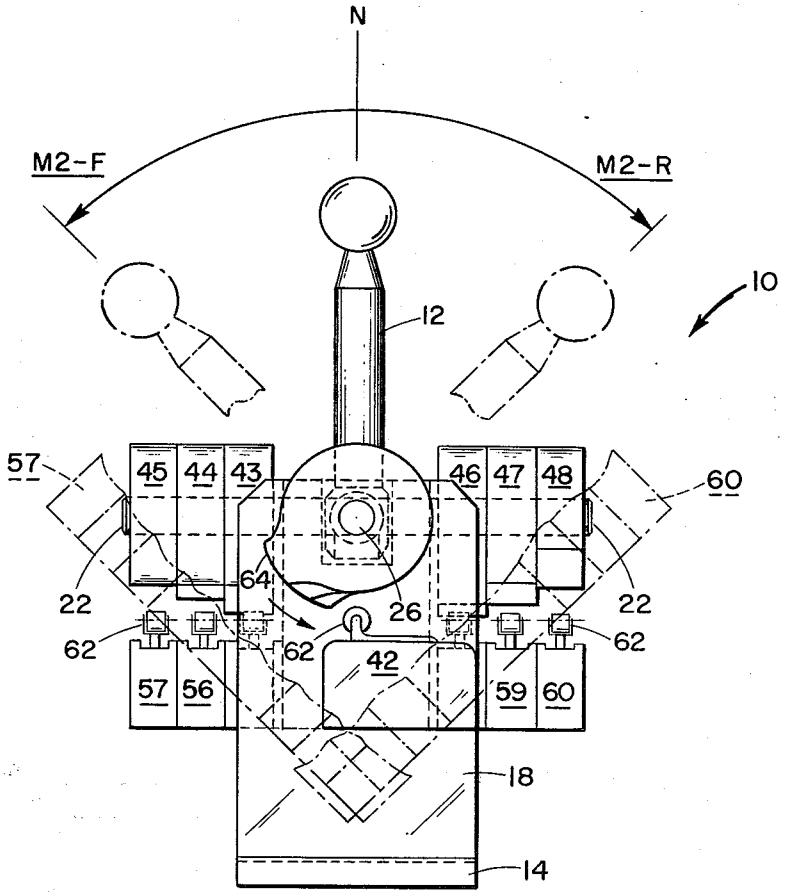
FIG. 2 is a side elevational view of the present apparatus wherein the range of motion of the control handle along the other axis is illustrated in phantom.
Figure 1:
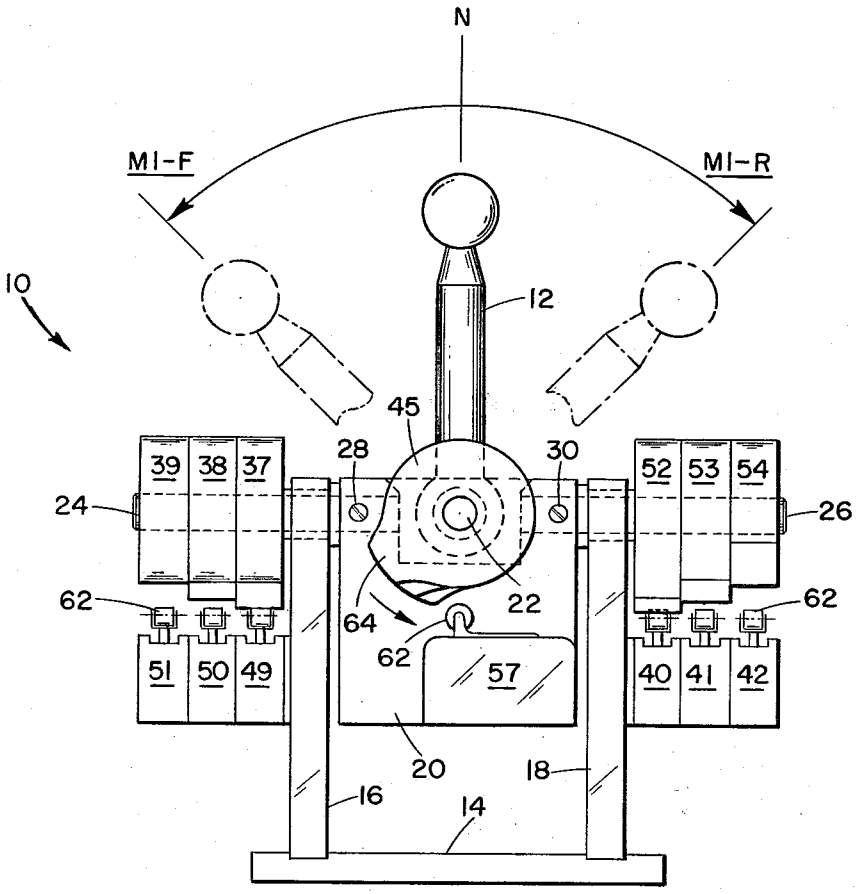
FIG. 1 is a front elevational view of the present control mechanism illustrating particularly the null position and, in phantom, the opposite ranges of the control handle along one axis.
Figure 3:
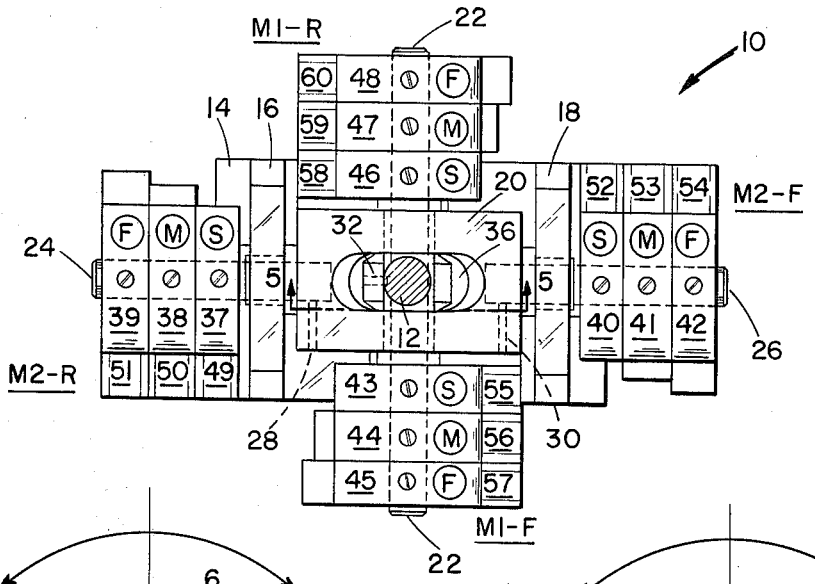
FIG. 3 is a top view of the present control mechanism as illustrated in the null positions of FIGS. 1 and 2.

Referring first to FIGS. 1, 2, and 3, the present control mechanism can be seen at 10 to comprise a single control handle 12, a base member 14, and two side members 16 and 18. A housing 20 receives a shaft 22 therethrough in a manner to be described in more detail hereinafter. Axially aligned shaft elements 24 and 26 also extend into the housing 20 in a manner to be described in greater detail hereinafter. The shaft elements 24 and 26 are supported in openings in the side members 16 and 18 respectively. The shaft elements 24 and 26 are attached to the housing 20 by means of screws 28 and 30 respectively. Thus, rotation of the housing 20 in a plane perpendicular to the longitudinal axes of the shaft elements 24 and 26 also causes said shaft elements to rotate about the longitudinal axes.

Figure 4:
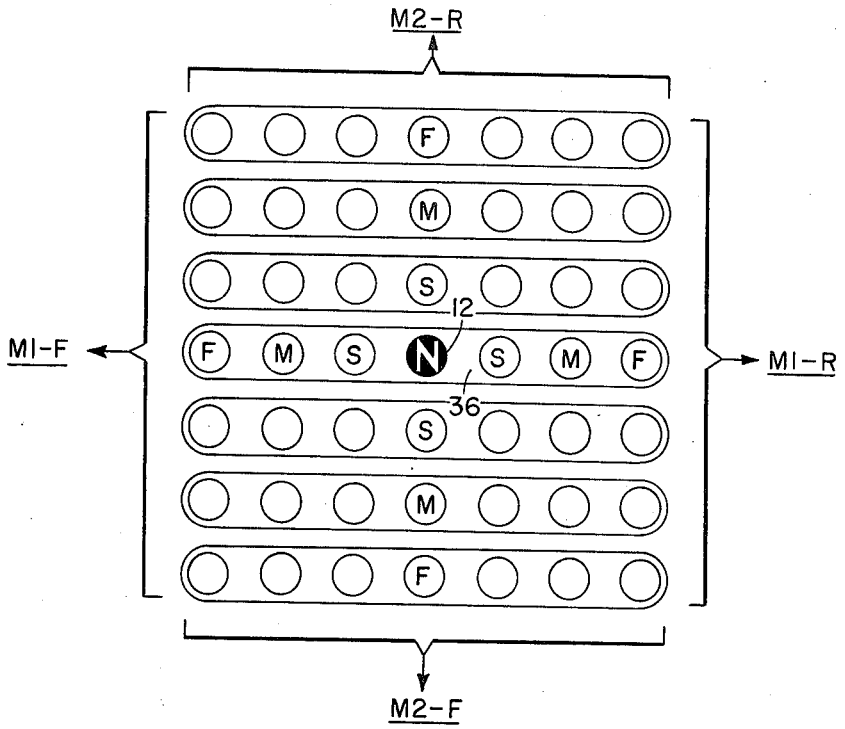
FIG. 4 is a diagram illustrating the multiple control positions in which the control handle can be disposed to provide a full range of operations of two multiple-operation motive devices.
Figure 5:
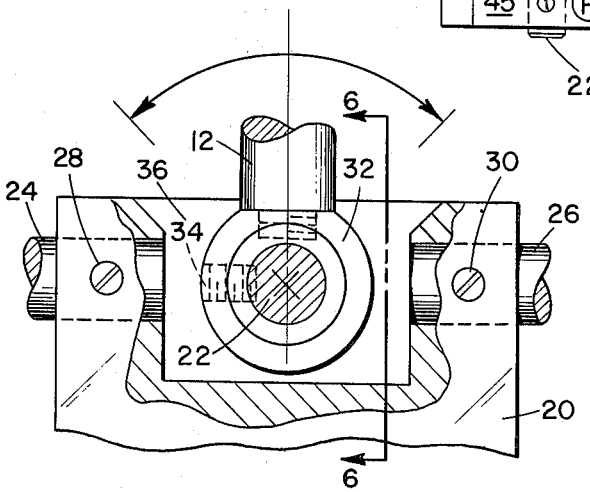
FIG. 5 is a partial sectional view taken along line 5—5 of FIG. 3; and, FIG. 6 is a partial sectional view taken along line 6—6 of FIG. 5.
Figure 6:
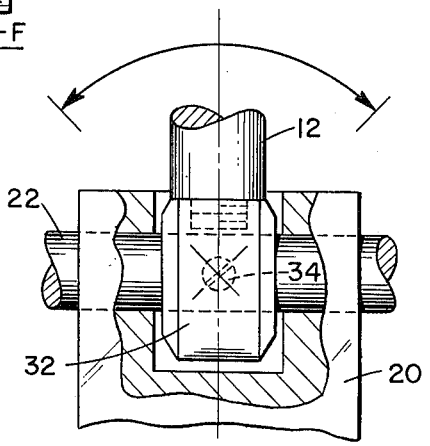

As can be seen in more detail in FIGS. 5 and 6, a coupler 32 is carried on the shaft 22 centrally within the interior of the housing 20. The coupler 32 is attached to the shaft 22 by means of a screw 34. The shaft 22 is carried within openings in oppositely spaced walls of the housing 20, the opening serving as bearings to allow rotation of the shaft 22 about its longitudinal axis. The housing 20 is seen also to have a slotted opening 36, positioned above the coupler 32, the control handle 12 extending into the opening 36 and attaching to the coupler 32 by means of a screw. Thus, movement of the control handle 12 in a plane perpendicular to the longitudinal axis of the shaft 22 (as seen in FIG. 1 and FIG. 5) causes the shaft 22 to rotate about its longitudinal axis since the motion of the control handle 12 is coupled to the shaft 22 through mutual attachment to the coupler 32. Rotational motion of the shaft 22 about its longitudinal axis causes cam elements 43, 44, 45, 46, 47, and 48 to also rotate, the said cam elements being fixedly attached to the shaft 22 at selected positions thereon. As can be particularly seen in FIGS. 1 and 2, the cam elements 43, 44, and 45 located on one end of the shaft 22 have the camming surfaces 64 thereof offset relative to each other. In this manner, the respective camming surfaces 64 of the cam elements 43, 44, and 45 successively contact roller elements 62 of switches 55, 56 and 57 in a predetermined sequence. Movement of the control handle 12 from a null or neutral positon, such as is designated by N in FIG. 4, to a first position, designated S, toward the left of the N position, causes the cam element 43 to contact the roller element 62 on the switch 55, thereby to actuate the switch 55. Further movement of the control handle 12 to the M and F position shown in FIG. 4 causes the camming surfaces 64 of the cam elements 44 and 45 to contact respective roller elements 62 on the switches 56 and 57 to activate said switches. The camming surfaces 64 can be configured to cause previously actuated switches to inactivate as succeeding switches are activated, to remain activated, or any desired combination thereof. As shown in the drawings, each cam element disengages the roller element on the previously actuated switch along each major axis of the mechanism 10 as the next switch is activated. In this way, motors, designated as M1 and M2, can be driven through varying speeds in either forward F or reverse R cycles.

In like manner, the cam elements 46, 47, and 48 actuate the switches 58, 59, and 60. The switches 55 through 60 are mounted on the housing 20 itself and respectively opposing the cam elements 43 through 48. In a similar fashion, the cam elements 37 through 42 actuate the switches 49 through 54, the switches 49 through 54 being successively mounted to the side members 16 and 18 and respectively opposing the cam elements 49 through 54. Movement of the control handle 12 (as seen in FIG. 2 and FIG. 6) in a plane perpendicular to the longitudinal axes of the shaft elements 24 and 26 causes the entire housing 20 to rotate. Since the shaft elements 24 and 26 are fixedly attached to the housing 20 by means of the screws 28 and 30, the cam elements 49 through 54 are rotated into sequential contact with the roller elements 62 on the switches 55 through 60 in a predetermined fashion.

As can be seen in FIG. 4, the control handle 12 can assume a plurality of positions wherein both the shaft 22 and the shaft elements 24 and 26 are rotated to produce actuation of selected switches which lie along both axis of the mechanism 10. In this manner, two separate motors (or other motive devices, lights, etc.) can be operated at varying speeds and in varying directions. The present control mechanism 10 allows, for example, the operation of a stacking unit or the like (not shown) whereby the stacking unit is driven by two motors, such as M1 and M2, and is caused to travel, raise, and/or lower simultaneously and in a number of speed combinations. Obviously, only one of the motors could be operated by moving the control handle 12 along only one of the operational axes of the mechanism 10.

Obviously the present control mechanism 10 can be configured in a variety of ways not expressly shown or described while remaining within the scope of the appended claims. Further, ancillary devices, such as a "dead-man" , could cause the control handle 12 to return to the null or neutral position if the operator of the mechanism 10 released his grasp on the handle. A wide variety of devices can be controlled by the present mechanism 10 either through actuation of switches such as described or by causing the cam elements to activate other cam-operated ancillary mechanisms.

What is claimed is:

1. A control mechanism for controlling a plurality of multiple-operation motive devices either separately or simultaneously comprising:

a control handle means operable by the user of said mechanism;

a pivot means connected to the control handle means at one end thereof;

a coupling means for coupling said pivot means to said control handle means, said coupling means having a channel provided therein;

a housing means, said coupling means being disposed interiorly of said housing means, said housing means having a slot provided in a surface thereof for receiving said control handle means therethrough and further having at least two pairs of aligned apertures in other surfaces thereof;

shaft means pivotally connected to said pivot means, said shaft means including at least one shaft unit which is received within said channel in said coupling means and positioned within one pair of said aligned apertures in said housing, said shaft means further including aligned separate shaft elements received and fixedly held within the other of said pair of aligned apertures of said housing, said shaft elements being pivotally mounted in said pivot means;

camming means fixed to portions of the ends of each of said shaft elements and said one shaft unit; and switch means interfaced with said motive device, movement of said control handle means in a plane perpendicular to said aligned longitudinal axes of said shaft elements and one of said shaft unit causing said shaft elements to rotate about their longitudinal axes and thereby to rotate at least certain of said camming means into contact with at least certain of said switch means.

2. The control mechanism of claim 1, wherein the longitudinal axis of said shaft unit and the longitudinal axes of said shaft elements are disposed perpendicular to the other, movement of said control handle means in a direction along either of said longitudinal axes causing rotation of that portion of said shaft means lying along the other of said longitudinal axes.

3. The control mechanism of claim 1, wherein said switch means consist of electrical switches having roller elements oppositely disposed from the camming means and which are contacted by the camming means on rotation of the shaft means.

* * * * *